US006259792B1

(12) United States Patent
Lambrecht

(10) Patent No.: US 6,259,792 B1
(45) Date of Patent: Jul. 10, 2001

(54) WAVEFORM PLAYBACK DEVICE FOR ACTIVE NOISE CANCELLATION

(75) Inventor: J. Andrew Lambrecht, Austin, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 08/895,802

(22) Filed: Jul. 17, 1997

(51) Int. Cl.[7] ..... H04R 3/02
(52) U.S. Cl. ..... 381/73.1; 381/71.13; 381/94.1
(58) Field of Search ..... 381/71.1–71.14, 381/94.1–94.9, FOR 123, FOR 124, 73.1; 187/206, 224

(56) References Cited

U.S. PATENT DOCUMENTS

| | | | | |
|---|---|---|---|---|
| 4,417,098 | * | 11/1983 | Chaplin et al. | 381/71.12 |
| 4,654,871 | * | 3/1987 | Chaplin et al. | 381/72 |
| 5,371,802 | * | 12/1994 | McDonald et al. | 381/71.4 |
| 5,402,496 | * | 3/1995 | Soli et al. | 381/94.2 |
| 5,418,857 | * | 5/1995 | Eatwell | 381/71.14 |
| 5,481,615 | * | 1/1996 | Eatwell et al. | 381/71.6 |
| 5,485,523 | * | 1/1996 | Tamamura et al. | 381/86 |
| 5,511,127 | * | 4/1996 | Warnaka | 381/71.7 |
| 5,590,206 | * | 12/1996 | An et al. | 381/71.13 |
| 5,638,022 | * | 6/1997 | Eatwell | 381/71.11 |
| 5,699,436 | * | 12/1997 | Claybaugh et al. | 381/71.6 |
| 5,781,640 | * | 7/1998 | Nicolino, Jr. | 381/73.1 |
| 5,805,714 | * | 9/1998 | Kasama et al. | 381/71.8 |

FOREIGN PATENT DOCUMENTS 5-40488 * 2/1993 (JP) ..... 381/73.1

OTHER PUBLICATIONS

Rosch, W., *The Winn L. Rosch Hardware Bible, Third Edition*, 1994, pp. 625–641.

* cited by examiner

*Primary Examiner*—Xu Mei
(74) *Attorney, Agent, or Firm*—Conley, Rose & Tayon, PC; B. Noël Kivlin

(57) ABSTRACT

A noise environment is sampled via microphone. A processor generates a cancellation signal to offset the effects of the noise to a listener. The cancellation signal is converted into a sample signal compatible with a synthesizer. The synthesizer adjusts the pitch, amplitude and timing of a sample of a patch set to create a substantially continuous output cancellation signal. The continuous output cancellation signal is output via a speaker. The output cancellation signal combines with the noise environment to reduce the effects of the noise environment on the listener. Alternatively, in previously characterized noise environments, one or more cancellation signals may be stored in processor. The processor receives a user input selecting the appropriate cancellation signal and adjusting the parameters of the cancellation signal. After the processor has calculated or selected the cancellation signal and transferred the sampled signal to the synthesizer, the processor is no longer involved in the generation of the cancellation signal. Therefore, the noise cancellation function requires relatively little processing power and is accomplished without the need for special purpose hardware.

41 Claims, 5 Drawing Sheets

WAVEFORM PLAYBACK DEVICE FOR ACTIVE NOISE CANCELLATION

BACKGROUND OF THE INVENTION

1. Field of the Invention

The present invention relates to waveform playback devices and, more particularly, to active noise cancellation using waveform playback devices.

2. Description of the Relevant Art

Waveform playback devices, such as wavetable synthesizers, produce sound by using samples, or recordings, of instruments. Sound is produced by pitch shifting and looping samples to produce the desired sound. Pitch shifting and looping vary note pitch and duration of a finite number of samples to produce the desired sound. Other waveform playback devices, such as streaming wave playback devices, produce sound from a continuous data stream. The continuous data stream is a stream of digital data representing an audio signal.

Wavetable synthesizers use stored recordings of instruments to produce sound. The group of stored recordings is referred to as a patch set. A patch set typically comprises recordings from a plurality of instruments. Each patch comprises one or more recorded samples of an instrument. For example, a sample may be one note of a particular instrument. Wavetable synthesizers produce sound by pitch shifting and looping one or more samples. For example, a patch set may include a plurality sound recordings from a plurality of musical instruments such as a piano, a string instrument, and a trumpet. Each patch consists of one or more samples of an instrument, e.g., one or more notes of a piano. To synthesize the sound of a piano, a piano sample is selected. The selected sample is pitch shifted and looped to produce the desired sound. Multiple notes of the piano may be simultaneously synthesized. Multiple instruments may be synthesized by using samples from different patches. Sounds other than musical instruments may be synthesized by adding non-musical instrument patches to the patch set of the wavetable synthesizer.

A wavetable synthesizer may interface with a processor. The processor downloads the information necessary for the wavetable to synthesize the desired sound. The processor may specify the sample to use, frequency shifting data, looping data and amplitude data. The synthesization of the sound may be then performed by the wavetable independent of the processor. One standard for enabling a processor to provide commands to a wavetable synthesizer is referred to as MIDI (Musical Instrument Digital Interface).

Noise cancellation is a method of reducing the noise perceived by a listener. Noise cancellation is typically accomplished by outputting a noise cancellation signal that is the inversion of the noise that is desired to be cancelled. The noise and the noise cancellation signal combine to form a DC signal that is inaudible to the listener. One popular method for performing noise cancellation is to input a noise signal indicative of the noise that is desired to be cancelled, invert the noise signal and output the inverted noise signal. Although some delay is inherent in inputting, inverting and outputting the noise signal, the delay can be minimized such that a combination of the original noise signal and the inverted noise signal is substantially a DC signal. Unfortunately, noise cancellation typically requires specialized hardware to invert the noise signal at a rate which introduces a sufficiently minimized delay. Alternatively, noise cancellation can be accomplished using a general purpose processor, such as a personal computer. Noise cancellation using a general purpose computer typically requires a significant amount of processing power to sample and invert the noise. What is desired is a system and method for noise cancellation that minimizes the processing power necessary to calculate noise cancellation signals and does not require specialized hardware.

SUMMARY OF THE INVENTION

The present invention contemplates a system and method for active noise cancellation using a waveform playback device. The present invention uses existing hardware, such as a personal computer with an attached waveform playback device. The background noise, or other noise to be canceled, may be sampled via a microphone. The noise to be canceled is referred to as a "noise environment." A software application running on a host processor calculates a cancellation signal. A cancellation signal is a signal that combines with the noise environment to negate or reduce the noise perceived by a listener. The cancellation signal is converted into a cancellation sample signal compatible with the waveform playback device. The sample signal is conveyed to the waveform playback device and the device outputs an audio signal of a selected sample at the appropriate pitch and duration. The audio signal is output to the listener via a speaker or headphone to accomplish the noise cancellation.

The present invention advantageously reduces the processing requirements of the host processor. Once the cancellation signal is calculated and the sample signal is conveyed to the waveform playback device, the processor is no longer involved in canceling the noise. The noise environment may be periodically resampled and a new cancellation signal calculated.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE DRAWINGS

Figure 1:
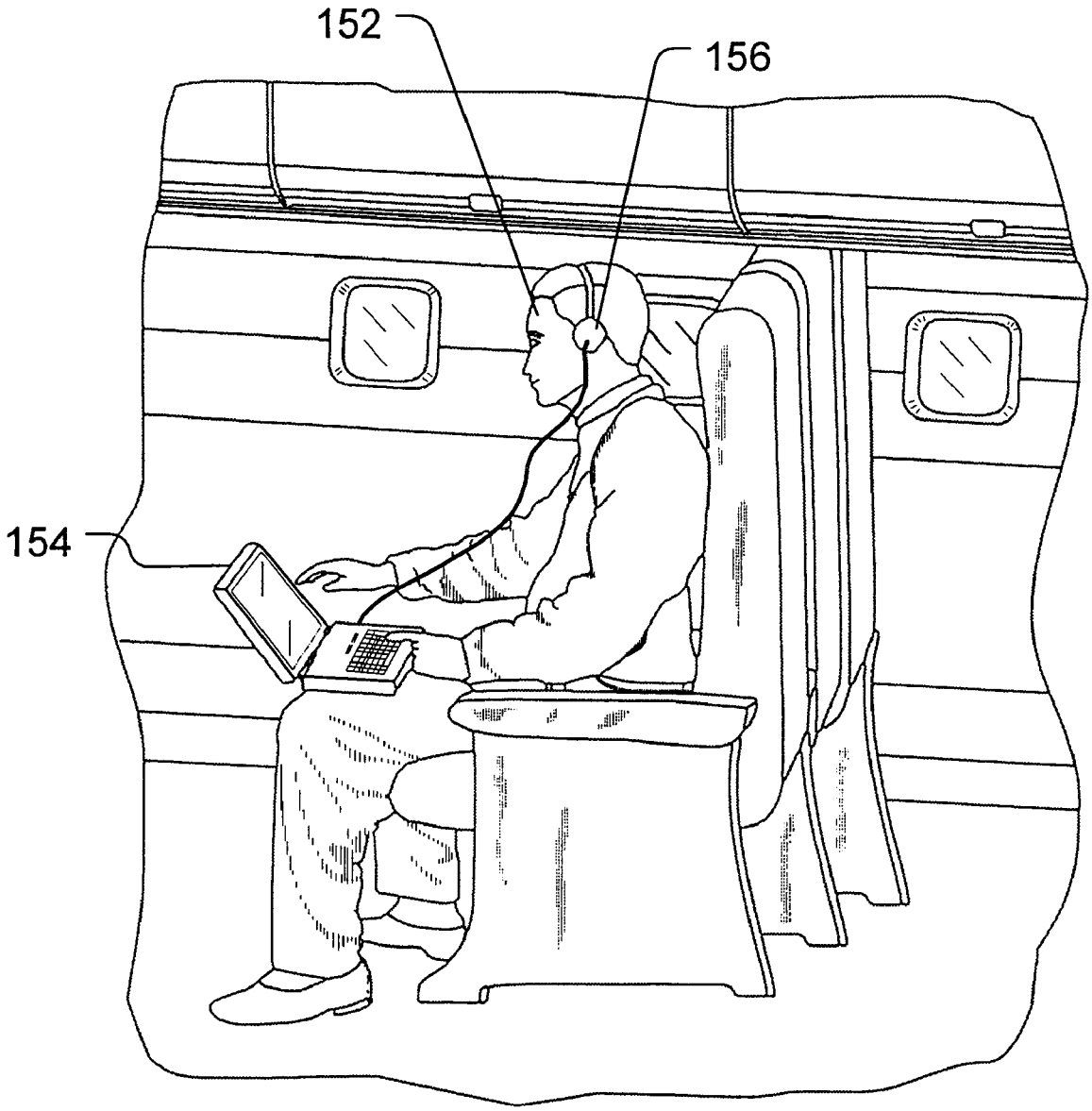
FIG. 1. is a diagram of one use of a waveform playback device in accordance with the present invention.

Referring now to FIG. 1, a block diagram of one use of the waveform playback device in accordance with present invention is shown. FIG. 1 illustrates a listener 152 using a computer 154 with a waveform playback device in accordance with present invention to cancel the background noise of an airplane. Computer 154 samples the background noise environment and output a noise cancellation signal to listener 152 via headphones 156. The noise cancellation signal combines with the background noise to reduce the background noise perceived by listener 152.

Figure 2:
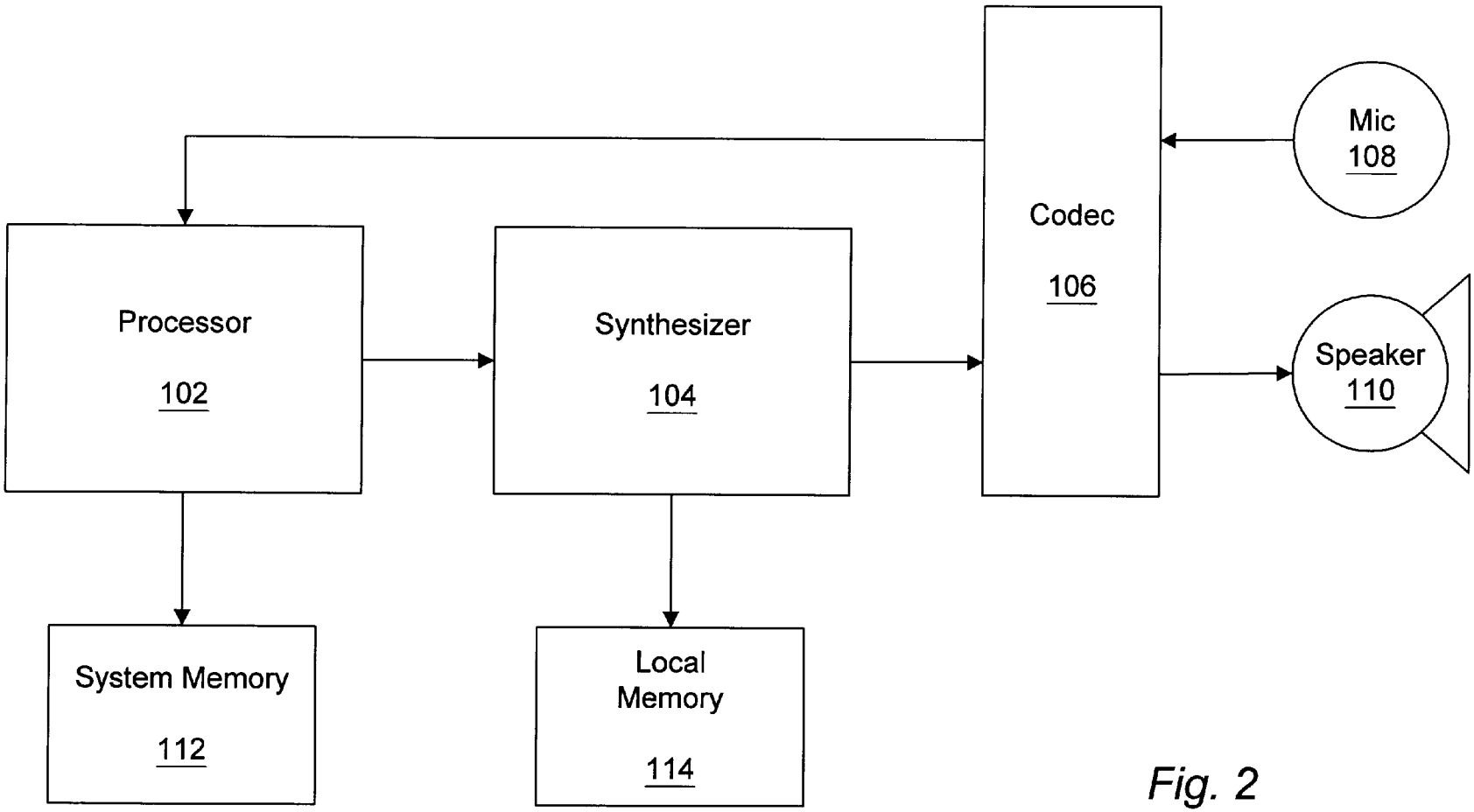
FIG. 2 is a block diagram of one embodiment of a system for canceling noise using a waveform playback device.

Referring now to FIG. 2, a block diagram of one embodiment of a system for active noise cancellation is shown according to the present invention. FIG. 2 illustrates a portion of a computer system. The elements in a computer system not necessary to an understanding of the present invention are omitted for simplicity.

The system includes a processor 102, a synthesizer 104, a CODEC 106, a microphone 108, a speaker 110, a system memory 112, and a local memory 114. Processor 102 is coupled to provide an output to synthesizer 104. Synthesizer 104 is coupled to provide an output to CODEC 106. CODEC 106 is coupled to receive an input from microphone 108 and to provide an output to speaker 110. System memory 112 is coupled to processor 102. Local memory 114 is coupled to synthesizer 104.

Processor 102 is a processing circuit capable of generating a cancellation signal and converting the cancellation signal into a cancellation sample signal. In a preferred embodiment, processor 102 is a microprocessor of a personal computer (PC). In other embodiments, processor 102 can be implemented in a variety of ways. For example, processor 102 may be a digital signal processor, a general purpose processor, digital logic, analog circuitry or a combination thereof.

Synthesizer 104 is a device capable of synthesizing audio signals from sample data. Synthesizer 104 may be any of a variety of standard synthesizers used to convert data into a continuous audio signal. For example, synthesizer 104 may be a hardware synthesizer, such as a wavetable synthesizer, or a software device, such as Microsoft's® DirectSound.

CODEC 106 is a combination coder/decoder that interfaces with I/O devices, such as microphones and speakers. CODEC 106 is any of a variety of conventional CODECs. In one embodiment, CODEC 106 converts digital audio signals to analog audio signals compatible with speaker 110, and converts analog audio signals from a microphone 108 to digital audio signals compatible with a digital processing system.

System memory 112 may be any conventional device for storing data. For example, system memory 112 may include one or more of the following: random access memory (RAM), read only memory (ROM), and non-volatile storage devices, such as hard disks or optical storage devices.

Local memory 104 may be any conventional device for storing data. For example, local memory 114 may include one or more of the following: RAM, ROM, and non-volatile storage devices. In one embodiment, local memory 114 includes ROM for storing a standard patch set and RAM for storing custom patches.

Microphone 108 is a conventional microphone that converts sound to electrical audio signals. In one embodiment, the microphone is physically located with the speaker or headphone. Speaker 110 is conventional speaker or headphone for converting electrical audio signals to audible sound.

The noise environment is sensed via microphone 108. Microphone 108 senses the noise environment and converts the noise to electrical audio signals which represent the noise and are received by CODEC 106. Microphone 108 detects the noise that is desired to be cancelled. Typically, the noise desired to be cancelled is background noise. For example, the background noise of an airplane may be sampled by microphone 108.

CODEC 106 receives an electrical representation of the noise environment, i.e. the noise audio signal, sensed by microphone 108. CODEC 106 converts the noise audio signal to a noise representation signal that is compatible with processor 102. For example, CODEC 106 may convert an analog signal received from microphone 108 to a digital representation of the analog signal. The digital representation of the analog signal, or noise representation signal, is output to processor 102. Thus the processor effectively receives the noise audio signals generated by the microphone.

Processor 102 receives the representation of the sampled noise environment or noise representation signals from CODEC 106. Processor 102 generates a cancellation signal based on the noise representation signals. As noted above, a cancellation signal is a signal that combines with the noise environment to negate or reduce the noise perceived by a listener. In one embodiment, the cancellation signal is an inversion of the sampled noise. Ideally, the cancellation signal combines with the noise environment to produce a DC signal. Because DC signals are inaudible to humans, the combination of the noise environment and the cancellation signal is inaudible to the listener. Typically, the cancellation signal is not a perfect inversion of the noise signal. Therefore, the combination of the cancellation signal and noise environment does not yield a DC signal. Cancellation signals with small imperfections, however, will significantly reduce the noise perceived by a listener when combined with the original noise environment.

In one embodiment, processor 102 converts the cancellation signal into sample information, or a cancellation sample signal, compatible with a waveform playback device such as a wavetable synthesizer. The cancellation sample signal is also called a sample-information signal. More specifically, system memory 112 stores software executed by processor 102 and execution of this software causes processor 102 to convert the cancellation signal into a cancellation sample signal. As noted above, a wavetable synthesizer uses stored recordings of instruments to produce sound. The synthesizer has a patch set, or group of instruments associated, with it. The patch set includes one or more patches or instruments. Each patch includes one or more samples, which are notes of the instrument. Although the patch set typically includes musical instruments, an anti-noise instrument, or anti-noise patch, can also be defined. An anti-noise patch is a patch that contains samples to offset, or cancel, a noise signal. Processor 102 determines the best sample from the anti-noise patch to reproduce the cancellation signal. Processor 102 additionally determines the appropriate pitch shifting, amplitude adjustments and looping of the anti-noise patch to reproduce the cancellation signal. In the above-described embodiment, the appropriate patch, and the pitch shifting, amplitude adjustment and looping information is sent from processor 102 to synthesizer 104 in the form of a sample signal. Multiple anti-noise patches may be defined as part of the patch set. For example, one anti-noise patch may effectively cancel airplane noise while another anti-noise patch may effectively cancel automobile noise.

Synthesizer 104 receives the cancellation sample signal identifying the appropriate anti-noise sample, and any amplitude, pitch shifting and looping data. Synthesizer 104 generates a continuous output cancellation signal from this cancellation sample signal. Synthesizer 104 selects the appropriate anti-noise sample. The amplitude and pitch of the anti-noise sample are varied by synthesizer 104. A looping mechanism repeats the amplitude and pitch adjusted anti-noise sample to produce a continuous output cancellation signal. Ideally, the continuous output cancellation signal output by synthesizer 104 is a reproduction of the cancellation signal generated by processor 102. After the sample signal is transmitted to synthesizer 104, processor 102 is no longer involved in the generation or outputting of the output cancellation signal. Therefore, processor 102 is free to perform tasks not related to noise cancellation.

The noise environment may be resampled at periodic intervals. When the noise environment is resampled, processor 102 again calculates a cancellation signal and transmits the appropriate cancellation sample information to generate the continuous output cancellation signal to synthesizer 104. Resampling the noise environment allows the system to adjust to changing noise environments.

Synthesizer 104 outputs the continuous output cancellation signal to CODEC 106. CODEC 106 converts the output cancellation signal to an audio signal compatible with speaker 110. For example, CODEC 106 may convert a digital representation of the output cancellation signal to an analog representation of the output cancellation signal. Speaker 110 receives the audio signal and outputs an audible cancellation signal to the listener. The audible cancellation signal combines with the noise environment to negate or reduce the noise perceived by the listener. In one embodiment, the audible cancellation signal is output to the listener via headphones and speaker 110 is incorporated into the headphone. In alternative embodiments, speaker 110 may be a stand-alone speaker or connected to a computer.

The patch set utilized by synthesizer 104 may be stored in either system memory 112 or local memory 114. In one embodiment, the patch set is stored in local memory 114. In one particular embodiment, the majority of the patch set is stored in a ROM portion of local memory 114. Local memory 114 may also include a RAM portion in which custom patches are stored. For example, an anti-noise patch may be defined as a custom patch and stored in the RAM portion of local memory 114. In another embodiment, the patch set is stored in system memory 112. In this embodiment, synthesizer 104 accesses the sample or samples as needed directly from system memory 112. In this manner, local memory 114 may be eliminated. In still other embodiments, portions of the patch set are stored in local memory 114 and other portions are stored in system memory 112.

In some embodiments, the interface between processor 102 and synthesizer 104 may not allow synthesizer 104 to access system memory 112. For example, if the interface between processor 102 and synthesizer 104 is an Industry Standard Architecture (ISA) bus then synthesizer 104 typically stores the patch set in local memory 114. If, however, the interface between processor 102 and synthesizer 104 is a Peripheral Component Interconnect (PCI) bus, then synthesizer 104 may be able to access patches directly from system memory 112.

Figure 3:
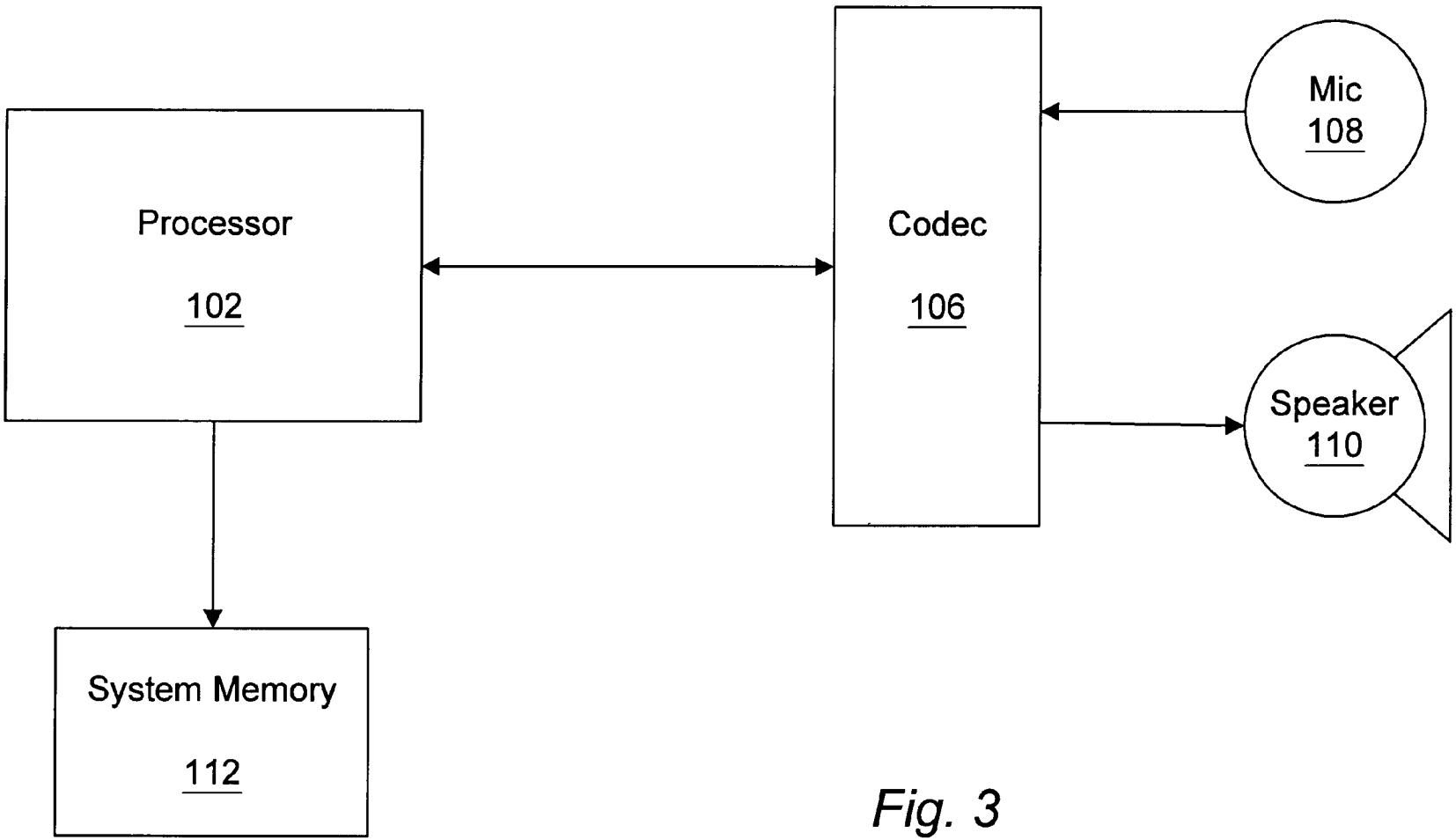
FIG. 3 is a block diagram of an alternate embodiment of a system for canceling noise using a waveform playback device.

Referring now to FIG. 3, another embodiment of a system for active noise cancellation is shown according to the present invention. Components which are similar or identical to those in FIG. 2 have the same reference numerals for convenience. FIG. 3 includes processor 102, CODEC 106, microphone 108, speaker 110, and system memory 112. Processor 102 is coupled to CODEC 106 and system memory 112. CODEC 106 is coupled to processor 102, microphone 108, and speaker 110.

In the illustrated embodiment, processor 102 includes a software wave playback device such as Microsoft's® DirectSound or DirectMusic. The software wave playback device replaces the hardware wave playback device, or wavetable synthesizer, shown in FIG. 2. Processor 102 creates a continuous wavefile. A wavefile is a stream of digital data representing an audio signal. CODEC 106 receives the wavefile and converts the wavefile to an audio signal compatible with speaker 110. Although the system of FIG. 3 eliminates the need for a wavetable synthesizer, the system of FIG. 3 requires more processing power to generate a continuous output cancellation signal.

Microprocessor 108 senses the noise environment and converts the noise to an electrical audio signal which is received by CODEC 106. CODEC 106 converts the audio signal to a signal that is compatible with processor 102. For example, CODEC 106 may convert an analog signal received from microphone 108 to a digital representation of the analog signal. Processor 102 receives the digital signal and generates a cancellation signal based on the sampled noise environment. As noted above, a cancellation signal is a signal that combines with the noise environment to negate or significantly reduce the noise perceived by a listener. Processor 102 converts the cancellation signal into a continuous wavefile. The wavefile is output to CODEC 106. CODEC 106 converts the wavefile to an audio signal compatible with speaker 110. For example, CODEC 106 may convert a digital wavefile signal to an analog audio signal. Speaker 110 receives the audio signal and outputs an audible cancellation signal to the listener. The audible cancellation signal combines with the noise environment to negate or reduce the noise perceived by the listener.

Figure 4:
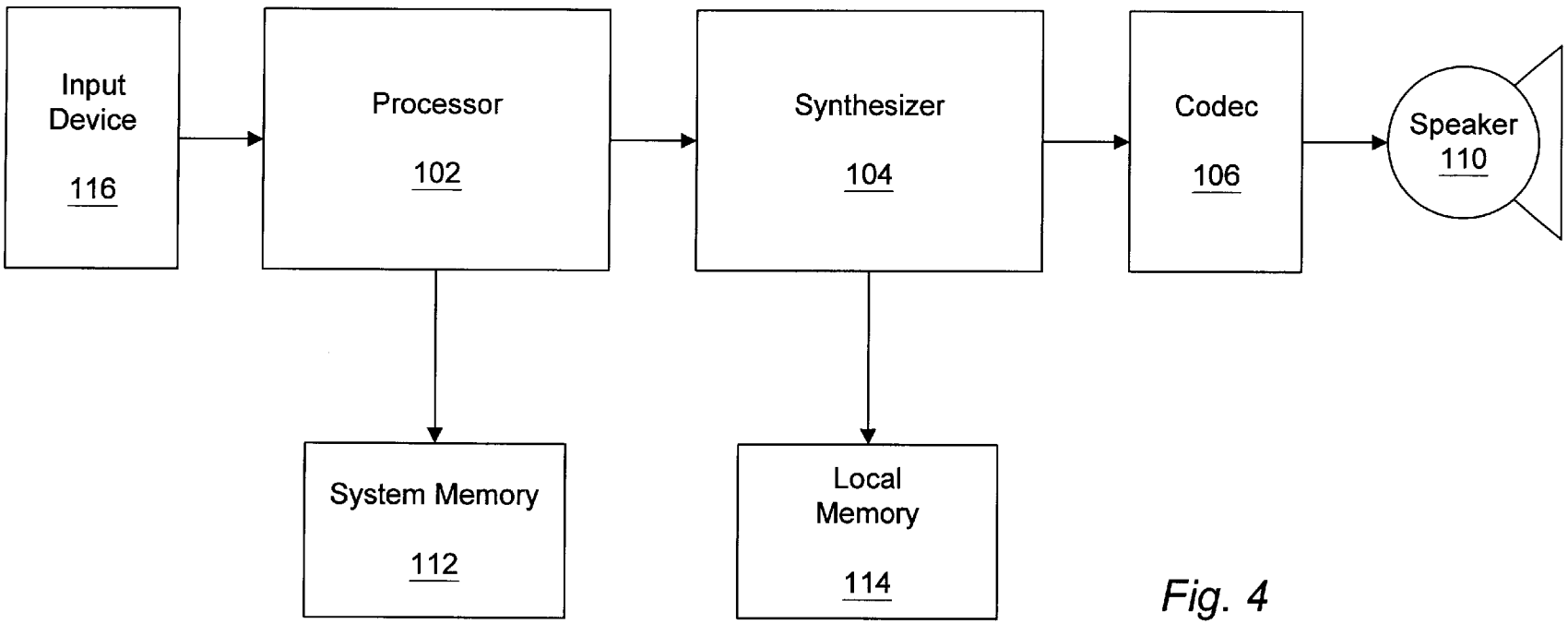
FIG. 4 is a block diagram of an alternate embodiment of a system for canceling noise using a waveform playback device.

In still another embodiment, the noise environment is known and relatively constant. For example, the background noise of an airplane is fairly constant and well known. In this embodiment, a cancellation signal may be predetermined and stored. In this embodiment, the noise environment does not have to be sampled and the cancellation signal is predetermined. The system illustrated in FIG. 4 receives an input from input device 116 rather than sampling the background noise. A user via input device 116 can select a predetermined cancellation signal and adjust parameters of that signal. In the illustrated embodiment, processor 102 transfers data to synthesizer 104 identifying one or more patches, and amplitude, pitch and looping data for those patches. Synthesizer 104 produces a continuous output cancellation signal which is transferred to CODEC 106. CODEC 106 outputs an audio signal compatible with speaker 110. In the above-described embodiment, a cancellation signal is produced with minimal processor throughput. Processor 102 is not required to sample the noise environment or calculate a cancellation signal. Processor 102 only needs to receive an input signal selecting a cancellation signal and data to modify the parameters of the cancellation signal, and transfer that information to synthesizer 104.

The above-described systems are effective for canceling relatively constant statistically predictable noise. For example, airplane noise is relatively constant and has a statistically predictable frequency spectrum. Because the noise is relatively constant and statistically predictable, a cancellation signal can be calculated without continuously sampling the noise environment. If the characteristics of the noise change at a relatively slow rate and remain statistically predictable, the above-described systems can effectively cancel noise by periodically updating the cancellation signal. For example, the system illustrated in FIG. 2 may periodically resample the noise environment and recalculate the cancellation signal. Alternatively, the system illustrated in FIG. 4 can effectively cancel changing noise environments by periodically adjusting the parameters of the existing anti-noise patch or by periodically selecting a new anti-noise patch. For the purposes of this disclosure, the term relatively constant applies to statistical predictability of the frequency spectrum of the noise signal. Although the characteristics of the noise may not be known at a particular instant of time, if the noise is statistically predictable, a cancellation signal that will negate or reduce the noise perceived by the listener can be determined.

Figure 5:
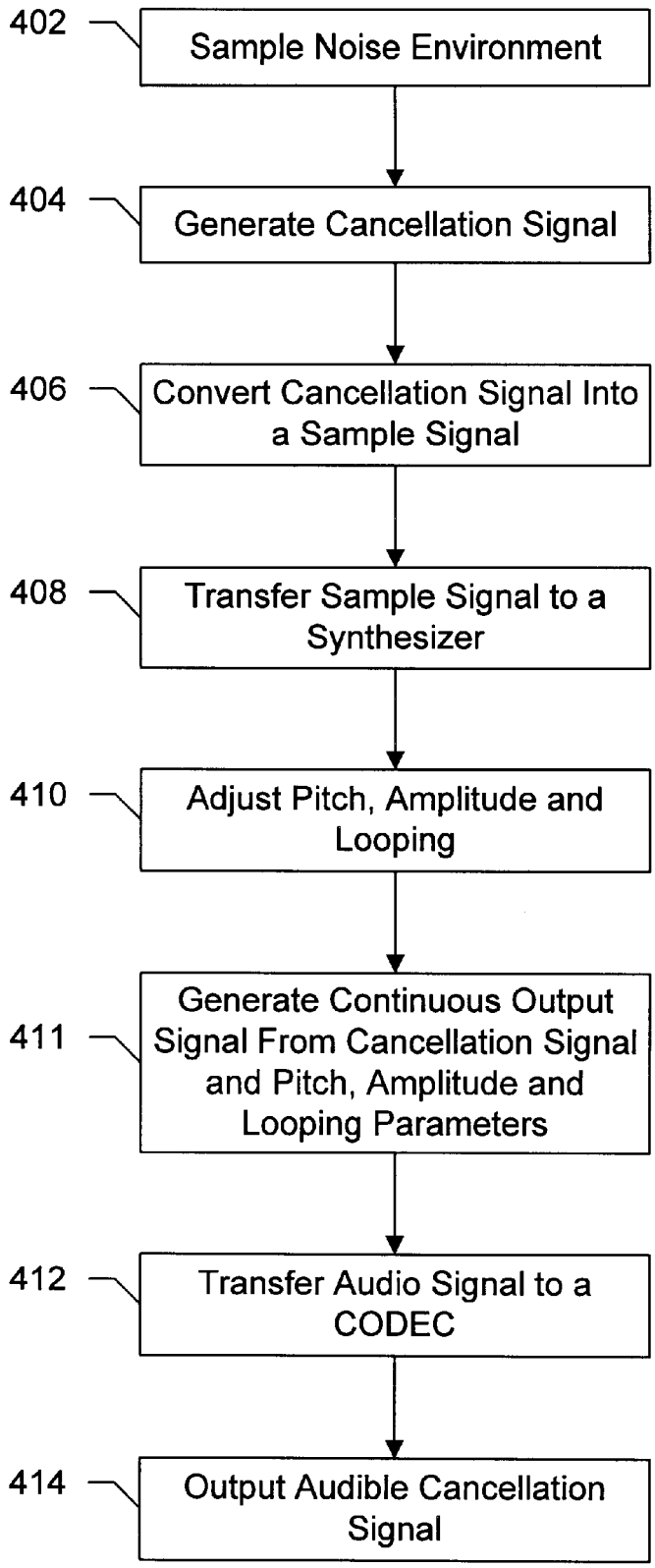
FIG. 5 is a flowchart diagram of a method for active noise cancellation using a waveform playback device.

FIG. 5 is a flowchart diagram illustrating the operation of one embodiment of an apparatus for noise cancellation. In step 402, the noise environment is sampled. The noise environment is the noise that is desired to be cancelled. In one embodiment, the noise environment is sampled via a microphone. In step 404, a cancellation signal is generated. A cancellation signal is a signal that combines with the noise environment to negate or reduce the noise perceived by a listener. In one embodiment, a processor generates a cancellation signal from the sampled noise environment. In one particular embodiment, the cancellation signal is an inversion of the sampled noise environment. In step 406, the cancellation signal is converted into a cancellation sample signal. For the purpose of this disclosure, a sample signal is a signal that is compatible with a synthesizer. A sampled signal may include data which identifies a particular sample of a patch, and/or specifies pitch shifting, looping and amplitude parameters. In step 408, the cancellation sample signal is transferred to a synthesizer. The synthesizer accesses the appropriate sample from a patch set. In one embodiment, the samples are stored in local memory. In another embodiment, the samples are stored in system memory and accessed by synthesizer 104 via an interface, such as a PCI bus. In step 410, adjustments are made to the sample. Adjustments made to the sample may include pitch shifting, amplitude adjustments, and looping. In step 411, a continuous output cancellation signal is generated. By adjusting the parameters of the sample, a close reproduction of the cancellation signal generated in step 404 is derived. In step 412, the continuous output cancellation signal is transferred to a CODEC. The CODEC converts the continuous output cancellation signal to an audio signal compatible with a speaker. In step 414, the audio signal is conveyed to the speaker which outputs an audible cancellation signal. The audible cancellation signal combines with the noise environment to negate or reduce the noise perceived by a listener.

Therefore, in one embodiment, the present invention comprises a microphone for sampling the background noise environment. A processor generates a cancellation signal to reduce the noise perceived by a listener. The processor converts the cancellation signal into a sample signal compatible with a synthesizer. The synthesizer selects a sample from a patch set and adjusts pitch, amplitude and timing to create a continuous representation of the cancellation signal. The continuous cancellation signal is output via a speaker. The continuous cancellation signal combines with the noise environment to negate or reduce the noise perceived by a listener.

While the invention is susceptible to various modifications and alternate forms, specific embodiments thereof are shown by way of example in the drawings herein described in detail. It should be understood, however, the drawings and detailed description thereto are not intended to limit the invention to the particular form disclosed, but on the contrary, the intention is to cover all modifications, equivalents, and alternatives falling within the spirit and scope of the present invention as defined by appended claims.

What is claimed is:

1. A system for canceling noise comprising:

a sound input device configured to sense a noise environment and to produce noise audio signals in response thereto;

a processor coupled to said sound input device, wherein said processor is configured to receive said noise audio signals and to generate a sample-information signal in response thereto;

a synthesizer coupled to said processor, wherein said synthesizer is configured to generate an output cancellation signal in response to said sample-information signal; and a sound output device coupled to said synthesizer, wherein said sound output device is configured to output an audible cancellation signal in response to said output cancellation signal;

wherein said noise environment is sampled for an interrupted time period and said output cancellation signal is substantially continuous.

2. The system for canceling noise of claim 1 wherein said processor is configured to generate a cancellation signal from said noise audio signals and to generate said sample-information signal from said cancellation signal.

3. The system for canceling noise of claim 2 wherein said sample-information signal is discontinuous.

4. The system for canceling noise of claim 3 wherein said audible cancellation signal output by said sound output device combines with said noise environment to reduce noise perceived by a listener.

5. The system for canceling noise of claim 2 wherein said sample-information signal identifies a sample of a patch set and parameters for adjusting said sample of said patch set.

6. The system for canceling noise of claim 5 wherein said parameters include pitch and duration.

7. The system for canceling noise of claim 5 wherein said sample of said patch set is stored in a memory local to said synthesizer.

8. The system for canceling noise of claim 5 wherein said sample of said patch set is stored in a system memory and said synthesizer is configured to access said system memory directly via an interface.

9. The system for canceling noise of claim 5 wherein said sample of said patch set is stored on a hard drive and downloaded to said synthesizer.

10. The system for canceling noise of claim 2 further comprising a codec coupled between said sound input device and said processor, and coupled between said synthesizer and said sound output device, wherein said codec is configured to convert a signal from said sound input device to a signal compatible with said processor, and to convert said output cancellation signal into a signal compatible with said sound output device.

11. The system for canceling noise of claim 1 wherein said synthesizer is a waveform playback device.

12. The system for canceling noise as recited in claim 1, wherein said processor is a microprocessor of a personal computer system.

13. The system for canceling noise as recited in claim 12, wherein said microprocessor is configured for calculating said cancellation sample signal.

14. The system for canceling noise as recited in claim 13, wherein said calculating cancellation sample signal includes pitch-shifting.

15. The system for canceling noise as recited in claim 14, wherein said calculating cancellation sample signal includes amplitude adjustment.

16. The system for canceling noise as recited in claim 15, wherein said calculating cancellation sample signal includes calculating looping information.

17. The system for canceling noise as recited in claim 16, wherein said microprocessor is configured to convey said cancellation sample signal to said synthesizer.

18. The system for canceling noise as recited in claim 17, wherein said synthesizer includes a looping mechanism, said looping mechanism configured to repeat an amplitude and pitch adjusted anti-noise sample in order to produce said output cancellation signal, and wherein said output cancellation signal is produced independent of said microprocessor.

19. A method for canceling noise comprising:

sampling a noise environment;

generating a sample-information signal in response to said sampled noise environment, wherein said sample-information signal is compatible with a synthesizer device;

generating an output cancellation signal in response to said sample-information signal; and outputting said output cancellation signal;

wherein said noise environment is sampled for an interrupted time period and said generating of said output sample-information signal is performed substantially continuously.

20. The method for canceling noise of claim 19 further comprising generating a cancellation signal, wherein said cancellation signal is generated in response to said sampled noise environment and said sample-information signal is generated in response to said cancellation signal.

21. The method for canceling noise of claim 19 wherein said continuous output cancellation signal is converted to an audible cancellation signal that combines with the noise environment to reduce noise perceived by a listener.

22. The method for canceling noise of claim 20 wherein said cancellation signal is converted to a sample of a patch set and parameters for adjusting said sample of said patch set.

23. A The method for canceling noise of claim 22 wherein said parameters include pitch and duration.

24. The method for canceling noise of claim 19 wherein said synthesizer accesses a patch set from memory local to said synthesizer.

25. The method for canceling noise as recited in claim 19, wherein said cancellation sample signal is generated by a processor of a personal computer system.

26. The method for canceling noise as recited in claim 25, wherein said cancellation sample signal is conveyed to said synthesizer device.

27. The method for canceling noise as recited in claim 26, wherein said outputting said cancellation signal is performed by said synthesizer device independent of said processor.

28. A system for canceling noise comprising:

an input device for selecting a predetermined cancellation signal, wherein a sample signal represents said selected cancellation signal;

a synthesizer coupled to said input device, wherein said synthesizer is configured to generate an output cancellation signal in response to said sample signal; and a sound output device coupled to said synthesizer, wherein said sound output device is configured to output an audible cancellation signal in response to said output cancellation signal.

29. The system for canceling noise of claim 28 wherein said sample signal is a sample of a patch set and parameters for adjusting said sample of said patch set.

30. The system for canceling noise of claim 29 wherein said parameters include pitch and duration.

31. The system for canceling noise of claim 28 wherein said sample of said patch set is stored in a memory local to said synthesizer.

32. The system for canceling noise of claim 28 further comprising a codec coupled between said synthesizer and said sound output device, wherein said codec is configured to convert said output cancellation signal into a signal compatible with said sound output device.

33. The system for canceling noise as recited in claim 28 further comprising a processor, wherein said processor is part of a personal computer system.

34. The system for canceling noise as recited in claim 33, wherein said processor is configured to transfer one or more patches to said synthesizer, and wherein said processor is also configured to transfer amplitude, pitch, and looping data for said patches.

35. The system for canceling noise as recited in claim 34, wherein said synthesizer is configured to generate said output cancellation signal based on said amplitude, pitch, and looping data for said patches.

36. The system for canceling noise as recited in claim 35, wherein said synthesizer is configured to generate said output cancellation signal independent of said processor.

37. A system for canceling noise comprising:

a sound input device configured to sampler a noise environment;

a processor coupled to said sound input device wherein said processor is configured to output a wavefile signal; and a sound output device coupled to said processor, wherein said sound output device is configured to output an audible cancellation signal in response to said wavefile signal;

wherein said noise environment is sampled for an interrupted time period and said processor is configured to generate a substantially continuous wavefile signal.

38. The system for canceling noise of claim 37 wherein said audible cancellation signal output by said sound output device combines with said noise environment to reduce noise perceived by a listener.

39. The system for canceling noise of claim 37 further comprising a codec coupled between said sound input device and said processor, and coupled between said processor and said sound output device, wherein said codec is configured to convert a signal from said sound input device to a signal compatible with said processor, and to convert said wavefile into a signal compatible with said sound output device.

40. The system for canceling noise as recited in claim 37, wherein said processor is a microprocessor of a personal computer system.

41. The system for canceling noise as recited in claim 40, wherein said processor includes a software wave playback device.

* * * * *